US006799565B2

(12) United States Patent
Cho

(10) Patent No.: US 6,799,565 B2
(45) Date of Patent: Oct. 5, 2004

(54) METHOD AND SYSTEM FOR CONTROLLING FUEL FOR AN ENGINE

(75) Inventor: Sang-Bum Cho, Seoul (KR)

(73) Assignee: Hyundai Motor Company, Seoul (KR)

( * ) Notice: Subject to any disclaimer, the term of this patent is extended or adjusted under 35 U.S.C. 154(b) by 55 days.

(21) Appl. No.: 10/299,873

(22) Filed: Nov. 18, 2002

(65) Prior Publication Data

US 2003/0094165 A1 May 22, 2003

(30) Foreign Application Priority Data

Nov. 22, 2001 (KR) ..... 2001-0072932

(51) Int. Cl.[7] ..... F02D 41/14

(52) U.S. Cl. ..... 123/675; 123/682; 701/104; 701/110

(58) Field of Search ..... 123/675, 682, 123/683, 698, 520; 701/103, 104, 109, 110

(56) References Cited

U.S. PATENT DOCUMENTS 4,991,102 A * 2/1991 Sakamoto et al. ..... 701/109
6,014,963 A * 1/2000 Narita ..... 123/674
6,227,177 B1 * 5/2001 Yamafuji et al. ..... 123/520
6,520,167 B1 * 2/2003 Kanno ..... 123/674

FOREIGN PATENT DOCUMENTS

| | | | | |
|---|---|---|---|---|
| JP | 17237 | * | 1/1985 | F02D/41/12 |
| JP | 261043 | * | 10/1996 | F02D/41/14 |
| JP | 264171 | * | 10/1997 | F02D/41/04 |
| JP | 166437 | * | 6/2003 | F02D/41/14 |
| KR | 2003-511291 | * | 3/2003 | F02D/41/14 |

* cited by examiner

*Primary Examiner*—Hai Huynh
(74) *Attorney, Agent, or Firm*—Morgan Lewis & Bockius LLP

(57) ABSTRACT

The present invention relates to a method and system for preventing a lean Air/Fuel ratio that may occur when accelerating an engine. An engine is supplied with a base amount of fuel that is adjusted, or compensated, according to one or more compensation variables that are based on an oxygen sensor signal. If the compensation variables are reduced by more than a predetermined amount and the throttle valve open-angle exceeds a predetermined value, then the method and system of the invention prevent a lean Air/Fuel ratio that may occur by initializing the compensation variables for a predetermined period of time, thereby allowing the engine to perform smoothly.

12 Claims, 4 Drawing Sheets

METHOD AND SYSTEM FOR CONTROLLING FUEL FOR AN ENGINE

FIELD OF THE INVENTION

The present invention relates to a method and system for controlling fuel for an engine, and more particularly, to a method and system for controlling fuel for an engine that prevents a lean Air/Fuel ratio from occurring at the beginning of sudden acceleration.

BACKGROUND OF THE INVENTION

A fuel system for a vehicle generally includes a system for reclaiming evaporated gas. This system gathers the evaporated gas, which is generated according to flow and temperature of fuel in the fuel tank, and bums it by routing it into the intake system of the engine. The gathered evaporated gas flows into the intake system through a solenoid controlled purge control valve that is operated according to the driving state of the vehicle. This prevents evaporated gas from polluting the air.

But evaporated gas includes both air and fuel components, making it difficult to maintain a desired theoretical Air/Fuel ratio by only controlling the amount of fuel injected. Also, driving conditions and the resulting engine load (e.g., engine RPM, and the negative pressure state in the intake manifold, which varies according to engine load) change the amount of evaporated gas passing through the purge control valve at any one time.

Additionally, it is difficult to cope promptly with the situation in which the Air/Fuel ratio changes suddenly in response to sudden variations in driving conditions. For example, accelerating after decelerating causes a transition from having a large negative pressure in the intake manifold to having a barely negative pressure in the intake manifold. The large negative intake manifold pressure makes the evaporated gas flow easily, but a barely negative intake manifold pressure reduces the evaporated gas flow. Thus, the flow of evaporated gas is reduced when acceleration occurs and the final Air/Fuel ratio becomes extremely lean. This causes drivability to deteriorate correspondingly and noxious exhaust gas expulsion to increase. Furthermore, when the Air/Fuel ratio becomes excessively lean, the engine may even stop, potentially causing a dangerous situation.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

The present invention is an improved method and system for controlling fuel for an engine. An embodiment of the invention prevents a lean Air/Fuel ratio and maintains a smoothly running engine when the amount of fuel needs to be changed suddenly, such as the case where the amount of injected fuel is insufficient when compared with the amount of drawn air because the inflow of evaporated gas into the engine is suddenly reduced.

A preferred embodiment of a system of the present invention for controlling fuel for an engine includes: a throttle open-angle detector for detecting a throttle valve open-angle; an oxygen concentration detector for detecting oxygen concentration of exhaust gas; a mass air flow detector for detecting an amount of air drawn into the engine; fuel injectors for injecting fuel to be supplied to the engine; and an electronic control unit for controlling the fuel injectors based on an amount of fuel to be supplied to the engine. The amount of fuel is calculated based on signals received from the detectors. The electronic control unit executes instructions for controlling fuel according to a control logic as described hereinafter.

In another preferred embodiment of the present invention, a method for controlling fuel for an engine includes: determining whether a base amount of fuel is reduced by more than a predetermined amount, the base amount of fuel being reduced according to one or more compensation variables calculated on the basis of an oxygen sensor signal; determining whether a change rate of a throttle valve open-angle is more than a predetermined change rate; initializing the compensation variables when the base amount of fuel is reduced by more than the predetermined amount, and the change rate of the throttle valve open-angle is more than the predetermined change rate; and repeating the calculation of the amount of fuel on the basis of the initialized compensation variables until a predetermined time after the initializing. The initializing of one or more compensation variables may initialize the variables to values that do not affect calculation of the amount of fuel. Preferably, the one or more compensation variables include a feedback gain calculated on the basis of said oxygen sensor signal and a learned reduction value calculated according to said feedback gain. When the base amount of fuel is compensated according to the one or more compensation variables by multiplying the feedback gain and the learned reduction value to the base amount of fuel, the initializing the one or more compensation variables may initialize the feedback gain and the learned reduction value to a value of one ("1").

Preferably, while repeating the calculation of an amount of fuel on the basis of the initialized compensation variables, the method of the present invention determines whether a current change rate of the throttle valve open-angle is reduced by more than a predetermined change rate, and suspends repeating the calculation of the amount of fuel on the basis of the initialized compensation variables when the current change rate of the throttle valve open-angle is less than the predetermined change rate.

BRIEF DESCRIPTION OF THE DRAWINGS

The following Detailed Description of the Preferred Embodiment will be better understood with reference to the figures, in which.

Like numerals refer to similar elements throughout the several drawings.

DETAILED DESCRIPTION OF THE PREFERRED EMBODIMENTS

Figure 1:
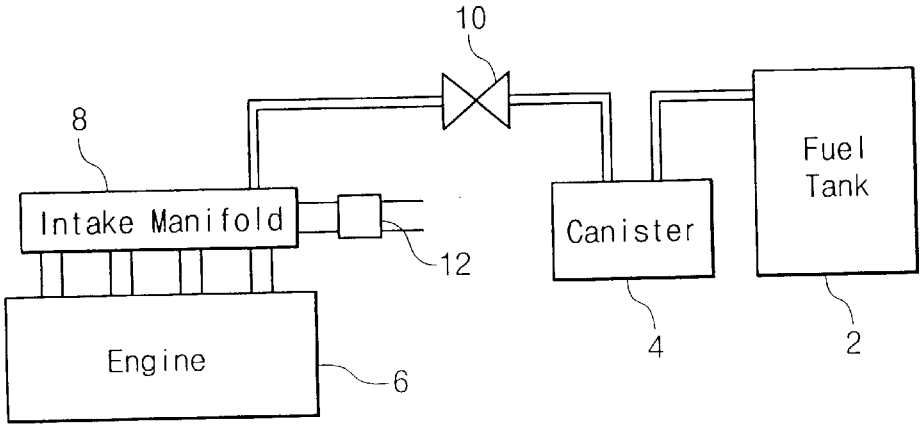
FIG. 1 is a schematic view of a system for controlling evaporated gas.

As shown in FIG. 1, evaporation gas that is generated in the fuel tank 2 is drawn through a canister 4 into an intake manifold 8 by negative pressure in the intake system. The amount of drawn evaporated gas is controlled by the purge control valve 10, which is itself controlled by an engine control unit (ECU). The Air/Fuel ratio is calculated from the amount of air detected by the mass air flow sensor 12. Mass air flow sensor 12 does not detect air from purge control valve 10. Therefore, to maintain the theoretical Air/Fuel ratio, the amount of evaporated gas in the drawn air has to be considered. To do this, the amount of evaporated gas is estimated from an Air/Fuel ratio feedback gain based on an oxygen sensor signal in the exhaust gas. The engine injectors inject the fuel in an amount that is compensated by the estimated amount.

Figure 5:
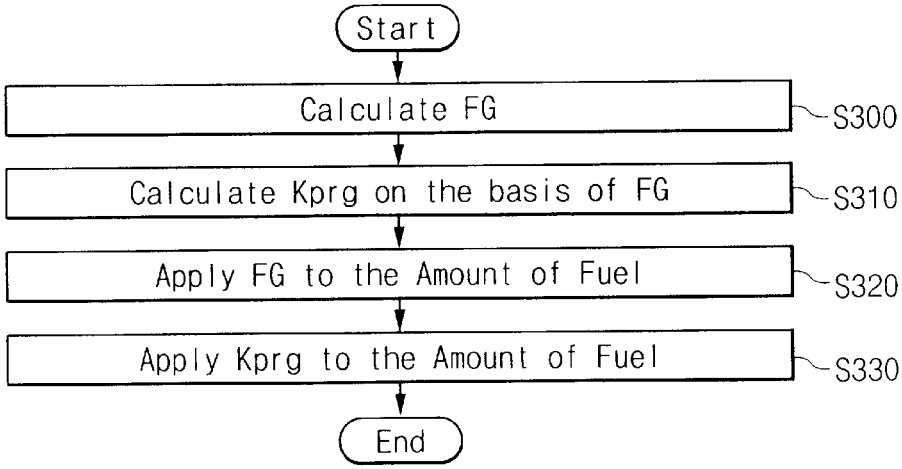
FIG. 5 is a flowchart of a method for controlling fuel for an engine.

The estimate is made as follows: when coolant temperature is higher than a predetermined temperature the ECU executes duty control for the purge control valve 10; the ECU follows a predetermined duty map that is based on RPM and engine load. As shown in FIG. 5, the fuel injectors are controlled by: calculating a feedback gain (FG) at step 300 based on the oxygen sensor signal; calculating a learned reduction value (Kprg) at step 310 from the degree that the feedback gain deviates from a standard value 1.0; applying the feedback gain (FG) at step 320 in calculating the amount of fuel; and applying the learned reduction value (Kprg) at step 330 in calculating the amount of fuel.

The learned reduction value (Kprg) does not usually respond promptly to a change in the estimated amount of evaporated. A time delay occurs because the learned reduction value (Kprg) is changed after estimating the Air/Fuel ratio from the exhaust gas. A filtering process makes this estimate change slowly. If the learned reduction value (Kprg) was determined to be under 1.0 before acceleration and the feedback gain was also under 1.0 because of rich exhaust gas, then intake manifold negative pressure decreases so that flow of evaporated gas is reduced when acceleration occurs. Therefore, because the effect of a lean Air/Fuel ratio is superimposed, as shown in FIG. 4B, the final Air/Fuel ratio becomes extremely lean.

Figure 2:
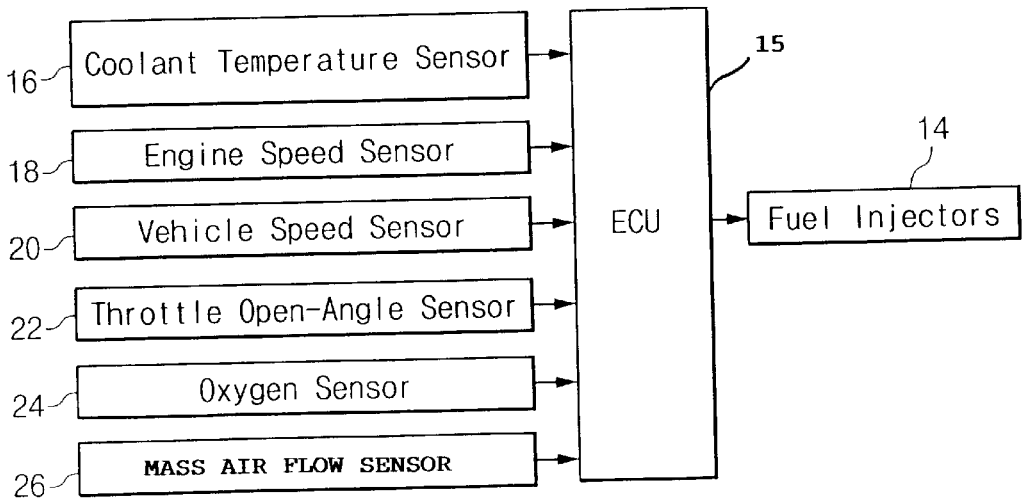
FIG. 2 is a block diagram of a system for controlling fuel for an engine according to a preferred embodiment of the present invention.

FIG. 2 shows a system, according to an embodiment of the invention that includes: detectors, including sensors, for converting variables about the state of the engine into electric signals; an ECU 15, for calculating the amount of fuel to be supplied to the engine on the basis of the signals transmitted by the detecting means and to transmit fuel supply signals; and injectors 14, for supplying fuel to the engine according to the fuel supply signals transmitted by the ECU 15.

The ECU 15 may contain one or more microprocessors operating a computer program with software instructions for performing a method for controlling fuel according to an embodiment of the present invention as described hereinafter. The detectors include: a throttle open-angle sensor 22, for detecting a throttle valve open-angle; an oxygen sensor 24, for detecting oxygen concentration of exhaust gas; and a mass air flow sensor 26, for detecting the amount of air drawn into the engine. They may further include: a coolant temperature sensor 16, for detecting coolant temperature of the engine; an engine speed sensor 18, for detecting the number of revolutions per unit time of the engine; and a vehicle speed sensor 20, for detecting a vehicle speed.

Figure 3:
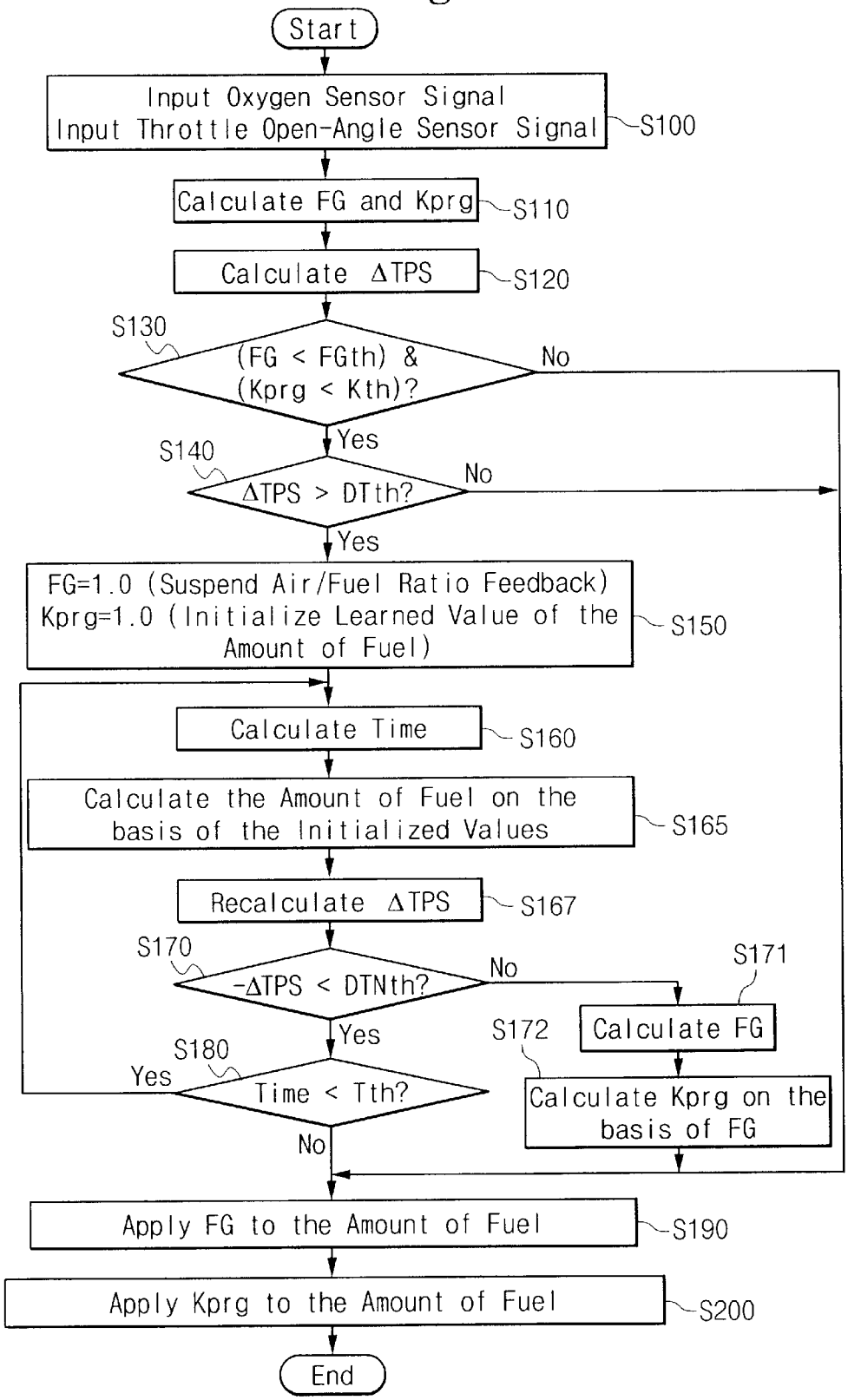
FIG. 3 is a flowchart of a method for controlling fuel for an engine according to a preferred embodiment of the present invention.

Now referring FIG. 3, at the start a purge control valve 10 (FIG. 1) is controlled by a predetermined duty cycle, according to the engine revolutions and load condition of the engine. At step 100, the detector (FIG. 2) signals from the oxygen sensor 24 (FIG. 2) and the throttle valve open-angle sensor 22 are input to the ECU 15. At step 110, a feedback gain (FG) is calculated according to the input signals, and a learned reduction value (Kprg) is calculated from the feedback gain (FG). At step 120, the ECU 15 calculates a rate of change of the throttle valve open-angle (ΔTPS), i.e., the amount the throttle valve open-angle changes per unit time, using the signal from the throttle open-angle sensor 22. At step 130, the ECU 15 determines whether the state exists such that the base amount of fuel is reduced, or "reduction-compensated," by more than a predetermined amount, the base amount of fuel being reduced according to the feedback gain (FG) and the learned reduction value (Kprg). In this determination, e.g., the base amount of fuel is reduced by more than the predetermined amount when the feedback gain (FG) is less than a predetermined reference feedback gain (FGth) and the learned reduction value (Kprg) is less than a predetermined learned reduction reference value (Kth). The predetermined reference feedback gain (FGth), predetermined learned reduction reference value (Kth), and predetermined change rate (ΔTPS—discussed below) are references and they may be set by a person skilled in the art for a particular application. If the feedback gain (FG) and the learning value (Kprg) are reduced by more than the reference values, then the Air/Fuel ratio may be lean and drivability may be deteriorated.

If the base amount of fuel is reduced by more than the predetermined level at step 130, then at step 140 it is determined whether the change rate of the throttle valve open-angle (ΔTPS), calculated at step 120, is more than a predetermined change rate (DTth).

The sudden opening of the throttle valve, as measured by the rate of change of the throttle valve open-angle (ΔTPS), indicates that the driver desires to accelerate quickly. If the change rate of the throttle valve open-angle (ΔTPS) is more than the predetermined change rate (DTth), the feedback gain (FG) and the learned reduction value (Kprg) are initialized at step 150. This initialization of the compensation variables (FG, Kprg) sets their values to values that do not affect calculation of the amount of fuel. Thus, it sets the initialized values to 1.0 in the case of compensating the amount of fuel by proportional operation, using FG and Kprg, or 0 (zero) where the compensating variables are defined in terms of how much fuel is added to or removed from the base amount of fuel. At step 160, the time elapsed (T) is calculated to determine whether the initialized values have been maintained a predetermined time (Tth). Then, at step 165, the amount of fuel is calculated on the basis of the above initialized variables (FG, Kprg), and the injectors 14 inject fuel according to the calculated amount of fuel. At step 167, the change rate of the throttle valve open-angle (ΔTPS) is recalculated. And at step 170 it is determined whether the change rate of the throttle valve open-angle (ΔTPS) is more than a predetermined change rate or whether the negative value of the change rate of the throttle valve open-angle (−ΔTPS) is less than a different predetermined value (DTNth). If the change rate of the throttle valve open-angle is not reduced by more than the predetermined change rate at step 170, at step 180 it is determined whether the time elapsed (T) after the initialization of variables is less than the predetermined time (Tth). This predetermined time (Tth) is determined through experimentation designed to improve drivability according to a lean Air/Fuel ratio and to minimize the increase of noxious exhaust gas according to suspension of feedback control.

If the predetermined time (Tth) after the initialization of variables is not elapsed at step 180, the variables remain initialized and the method advances to calculate the time elapsed (T) at step 160. If the predetermined time (Tth) after the initialization of variables is elapsed at step 180, at step 190 the feedback gain (FG) is applied to the amount of fuel, and at step 200 the learned reduction value (Kprg) is applied to the amount of fuel.

To apply the feedback gain (FG) to the amount of fuel, the feedback gain (FG) is multiplied by the base amount of fuel. And the base amount of fuel is calculated on the basis of the amount of air drawn into the engine, as detected by the mass air flow sensor signal. To apply the learned reduction value (Kprg) to the amount of fuel, the learned reduction value (Kprg) is multiplied by the amount of fuel calculated with application of the feedback gain (FG). Since, at this point, FG and Kprg remain in their initialized values, fuel is controlled according to an ordinary method for controlling fuel and the method starts over again.

Returning to step 130, if either of the variables (FG, Kprg) is not less than their corresponding reference, or, at step 140, the change rate of the throttle open-angle is less than the predetermined change rate (DTth) in the determination, the method advances to applying the feedback gain (FG) at step 190, and fuel is controlled according to the values of FG and Kprg, and the method starts again.

Returning to step 170, when the negative change rate of the throttle valve open-angle (−ΔTPS) is determined to be less than the predetermined change rate (DTNth), the feedback gain (FG) is calculated at step 171, and at step 172 the learned reduction value (Kprg) is calculated on the basis of this feedback gain (FG). The method advances and applies the feedback gain (FG) at step 190, Kprg at step 200, and fuel is controlled according to the ordinary method for controlling fuel and the method starts again.

Figure 4A:
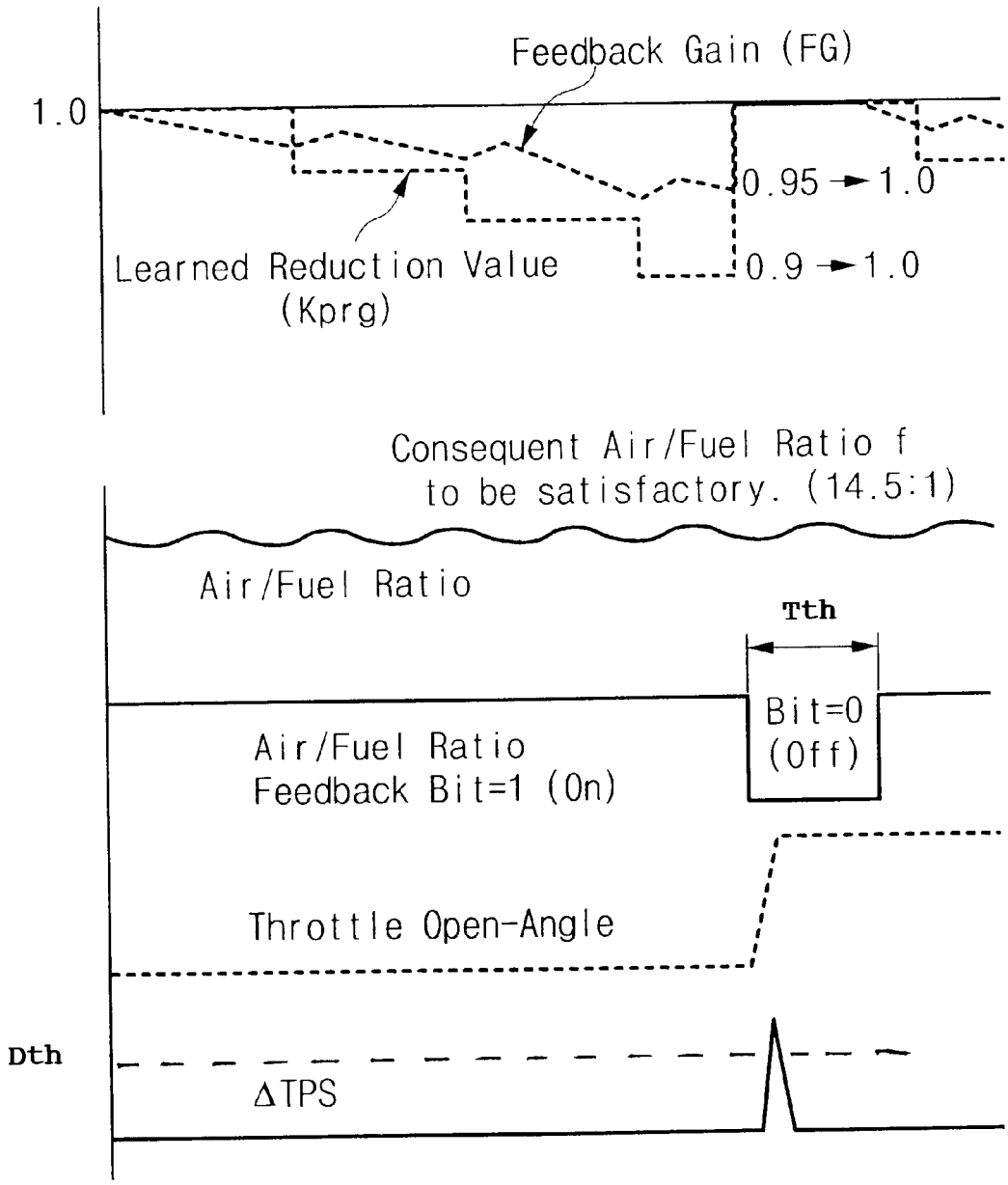
FIGS. 4A and 4B are graphs illustrating effects of controlling fuel.
Figure 4B:
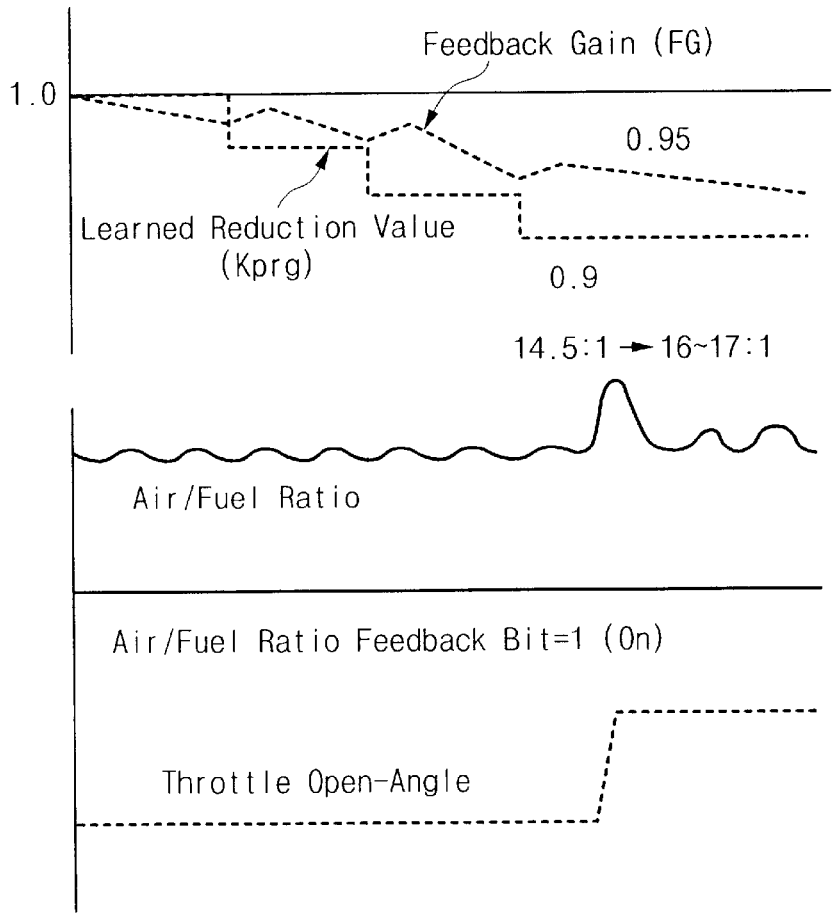

As shown in FIG. 4A, suspending the Air/Fuel ratio feedback control during the predetermined time (Tth) after the change rate of the throttle valve open-angle reached more than the critical value, prevented a lean Air/Fuel ratio and the corresponding deterioration of drivability by controlling the Air/Fuel ratio more stably compared with FIG. 4B, in which the system did not suspend the Air/Fuel ratio feedback control. Thus, an embodiment of the present invention, prevents a lean Air/Fuel ratio at the initiation of acceleration when rich evaporated gas is not inflowing, and the corresponding deteriorated drivability and increased noxious exhaust gas production.

While this invention has been described in connection with the preferred embodiment, it is to be understood that the invention is not limited to the disclosed embodiments, but, on the contrary, is intended to cover various modifications and equivalent arrangements that are within the spirit and scope of the appended claims.

Throughout this specification and the claims which follow, unless explicitly described to the contrary, the word "comprise" or variations such as "comprises" or "comprising" will be understood to imply the inclusion of stated elements but not the exclusion of any other elements.

What is claimed is:

1. A method for controlling fuel for an engine, comprising:

determining whether a base amount of fuel is reduced by more than a predetermined amount, the base amount of fuel being reduced according to one or more compensation variables calculated on the basis of an oxygen sensor signal;

determining whether a change rate of a throttle valve open-angle is more than a predetermined change rate;

initializing said one or more compensation variables when the base amount of fuel is reduced by more than the predetermined amount, and the change rate of the throttle valve open-angle is more than the predetermined change rate; and repeating the calculation of an amount of fuel on the basis of the initialized compensation variables until a predetermined time after the initializing.

2. The method of claim 1, wherein said initializing said one or more compensation variables initializes said one or more compensation variables to values that do not affect calculation of the amount of fuel.

3. The method of claim 1, wherein:

said one or more compensation variables comprise a feedback gain calculated on the basis of said oxygen sensor signal and a learned reduction value calculated according to said feedback gain; and said initializing said one or more compensation variables initializes said feedback gain and said learned reduction value to values that do not affect calculation of the amount of fuel.

4. The method of claim 3, wherein said determining whether the base amount of fuel is reduced by more than the predetermined amount comprises:

comparing said feedback gain with a predetermined gain value; and comparing said learned reduction value with a predetermined value.

5. The method of claim 3, wherein:

the base amount of fuel is reduced according to said one or more compensation variables by multiplying the feedback gain and the learned reduction value by the base amount of fuel; and said initializing said one or more compensation variables initializes said feedback gain and said learned reduction value to a value of "1".

6. The method of claim 1, wherein:

said repeating the calculation of an amount of fuel on the basis of the initialized compensation variables comprises:

determining whether a current change rate of the throttle valve open-angle is less than a predetermined change rate; and suspending repeating the calculation of the amount of fuel on the basis of said initialized compensation variables when the current change rate of the throttle valve open-angle is determined to be less than the predetermined change rate.

7. A system for controlling fuel for an engine comprising:

a throttle open-angle detector for detecting a throttle valve open-angle;

an oxygen concentration detector for detecting oxygen concentration in exhaust gas;

a mass air flow detector for detecting an amount of air drawn into the engine;

fuel injectors for injecting fuel to be supplied to the engine; and an electronic control unit for controlling said fuel injectors based on an amount of fuel to be supplied to the engine, the amount of fuel being calculated based on signals received from the detectors, said electronic control unit executing instructions for:

determining whether a base amount of fuel is reduced by more than a predetermined amount, the base amount of fuel being reduced according to one or more compensation variables calculated on the basis of an oxygen sensor signal;

determining whether a change rate of a throttle valve open-angle is more than a predetermined change rate;

initializing said one or more compensation variables when the base amount of fuel is reduced by more than the predetermined amount, and the change rate of the throttle valve open-angle is more than the predetermined change rate; and repeating the calculation of an amount of fuel on the basis of the initialized compensation variables until a predetermined time after the initializing.

8. The system of claim 7, wherein said initializing said one or more compensation variables initializes said one or more compensation variables to values that do not affect calculation of the amount of fuel.

9. The system of claim 7, wherein:

said one or more compensation variables comprise a feedback gain calculated on the basis of said oxygen sensor signal and a learned reduction value calculated according to said feedback gain; and said initializing said one or more compensation variables initializes said feedback gain and said learned reduction value to values that do not affect calculation of the amount of fuel.

10. The system of claim 9, wherein said determining whether the base amount of fuel is reduced by more than the predetermined amount comprises:

comparing said feedback gain with a predetermined gain value; and comparing said learned reduction value with a predetermined value.

11. The system of claim 9, wherein:

the base amount of fuel is reduced according to said one or more compensation variables by multiplying the feedback gain and the learned reduction value to the base amount of fuel; and said initializing said one or more compensation variables initializes said feedback gain and said learned reduction value to a value of "1".

12. The system of claim 7, wherein:

said repeating the calculation of an amount of fuel on the basis of the initialized compensation variables comprises:

determining whether a current change rate of the throttle valve open-angle is reduced by more than a predetermined change rate; and suspending repetition of calculation of the amount of fuel on the basis of said initialized compensation variables when the current change rate of the throttle valve open-angle is determined to be less than the predetermined change rate.

* * * * *